United States Patent [19]

Kazama et al.

[11] 4,113,608

[45] Sep. 12, 1978

[54] APPARATUS FOR SEPARATING NON-MAGNETIC MATERIALS OF DIFFERENT DENSITIES

[75] Inventors: Saburo Kazama, Hiratsuka; Hideo Abe, Yokosuka; Isao Satoh, Yokohama; Takashi Ikeguchi, Hitachi; Shunsuke Nogita, Hitachi; Masayoshi Kubota, Hitachi; Kiyoshi Muramori, Yokohama, all of Japan

[73] Assignee: Agency of Industrial Science and Technology, Tokyo, Japan

[21] Appl. No.: 720,502

[22] Filed: Sep. 3, 1976

[30] Foreign Application Priority Data

Sep. 3, 1975 [JP] Japan ..... 50-10600

[51] Int. Cl.[2] ..... B03B 5/28; B03B 13/04

[52] U.S. Cl. ..... 209/1; 209/172.5

[58] Field of Search ..... 209/1, 172, 172.5, 173

[56] References Cited

U.S. PATENT DOCUMENTS

| | | | |
|---|---|---|---|
| 693,684 | 2/1902 | Burgess | 209/173 |
| 902,658 | 11/1908 | Holland | 209/173 |
| 994,654 | 6/1911 | Parker | 209/173 |
| 2,356,648 | 8/1944 | Brusset | 209/172.5 |
| 2,603,352 | 7/1952 | Tromp | 209/172.5 |
| 3,028,962 | 4/1962 | Davis | 209/172.5 |
| 3,483,969 | 12/1969 | Rosensweig | 209/1 |

*Primary Examiner*—Frank W. Lutter
*Assistant Examiner*—Ralph J. Hill
*Attorney, Agent, or Firm*—Beall & Jeffery

[57] ABSTRACT

An apparatus for separating non-magnetic materials of different densities, which apparatus includes a material separating portion, in which a magnetic fluid is retained in a magnetic field having a gradient in a vertical direction. In this apparatus, a single conveyor is jointly used for the supply, and charging of materials to be separated, into the material separating portion, and the transporting of floating materials of a low density through the magnetic fluid and their recovery outside.

3 Claims, 6 Drawing Figures

APPARATUS FOR SEPARATING NON-MAGNETIC MATERIALS OF DIFFERENT DENSITIES

BACKGROUND OF THE INVENTION

1. Field of the invention

This invention relates to an apparatus for separating non-magnetic materials of different densities according to a difference in density of materials with the aid of a magnetic fluid.

2. Description of the prior art

Magnetic fluids are very stable suspensions of single domain magnetic particles. The suspended particles are so small (typically less than 150A°) that they do not settle under gravity or interact even in the presence of a strong magnetic field. The magnetic response of a magnetic fluid results from the coupling of individual particles with a substantial volume of the bulk liquid. This coupling is facilitated by a stabilizing agent which absorbs on the particle surface and is also solvated by the surrounding liquid.

A magnetic fluid placed in a non-homogeneous magnetic field experiences a net magnetic force which tends to drive it, like all magnetizable objects, towards regions of the highest magnetic intensity.

When a non-magnetic object is immersed in a magnetic fluid in the presence of a magnetic field gradient, there acts a magnetic force on the object, which tends to expel the object to a region of a minimum field.

Description will now be given of a prior art separating apparatus utilizing a difference in density for separating non-magnetic materials, in conjunction with FIGS. 1 and 2.

A magnet 1 produces a given magnetic field having a uniform gradient in a vertical direction in an air gap defined between pole pieces 2 thereof. Disposed within the air gap in the magnet 1 is a non-magnetic trough 3 extending at a right angle to the direction of the magnetic field produced by the magnet 1 but outwardly to both sides of the pole pieces 2. A magnetic fluid 4 is retained in a magnetic field in such a portion of the trough 3, which a magnetic field produced by a magnet 1 penetrates. This magnetic fluid forms a material-separating portion. The magnet 1 is energized by a coil 5. Materials 6 to be separated, which are made up of non-magnetic materials having varying densities, are supplied from a hopper 7 positioned on the lefthand top of the trough 3 into the trough 3, and then transported by means of a transporting conveyor 8 into the central portion of the magnetic fluid 4. Materials 6' having a density lower than an apparent density of the magnetic fluid 4 and contained in the materials 6, which have been charged into the magnetic fluid 4 for separation, float through the magnetic fluid 4 and are transferred by means of a conveyor 10 having material-raking flights 9 thereon and running through an upper portion of the trough 3, then discharged from the righthand end of the trough 3 outside to be recovered in a container 11. On the other hand, materials 6" having a high density sink through the magnetic fluid 4 and are transfered by means of a conveyor 12 positioned in the lower portion of the trough 3 and then taken from the lower lefthand end of the trough 3 outside to be recovered in a container 13.

With this apparatus, the height of a magnetic fluid serving as a material-separating portion should be increased. However, an increase in height of the magnetic fluid 4 tends to result in a lack of uniformity in apparent density of the magnetic fluid 4. In case the amount of materials to be separated is desired to be increased, then the dimensions of an air gap between the pole pieces 2 should be increased. This results in an extreme increase in size of a magnetic field generating means, and hence is not economical.

SUMMARY OF THE INVENTION

It is an object of the present invention to provide a novel apparatus for separating non-magnetic materials by avoiding the aforesaid shortcomings experienced with the prior art apparatus of the type described.

It is another object of the present invention to provide an apparatus for separating non-magnetic materials, which apparatus is simple in construction, presents a high processing capability and is economical.

According to the present invention, there is provided an apparatus for separating non-magnetic materials according to difference in density, which apparatus includes a material separating portion consisting of a magnetic fluid retained in a magnetic field having a gradient in a vertical direction and is characterized in that a single conveyor is jointly used for the supply and charging of materials to be separated, into the material separating portion, and transferring of floating materials of a low density through the magnetic fluid outside for their recovery.

DESCRIPTION OF THE PREFERRED EMBODIMENTS

Figure 1:
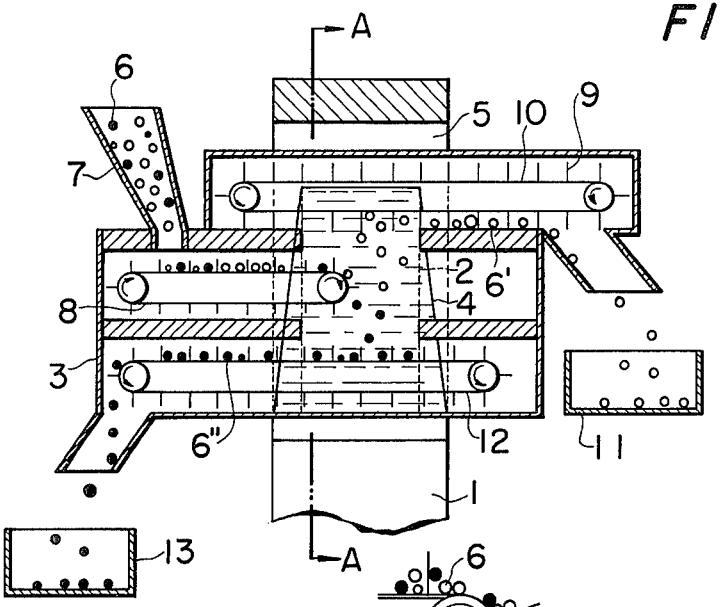
FIG. 1 PRIOR ART
FIG. 1 is a diagrammatic view showing the construction of a prior art material-separating apparatus.

Description will be given of the material-separating apparatus according to the present invention in conjunction with FIGS. 3 and 4.

Impressed in an air gap defined between pole pieces 2 of a magnet 1 is a magnetic field having a uniform gradient in a vertical direction. A magnetic fluid 4 is retained in such a space within the trough 3, which corresponds to an air gap defined between the pole pieces 2, with the sides of the magnetic fluid alone being confined by the side walls of the trough 3 which extends along the surfaces of the pole pieces 2. The magnetic fluid 4 constitutes a material-separating portion having uniform distribution of apparent densities.

Provided on one end of the trough 3 is a material-supply-guide plate 14 and provided on the other end of the trough 3 is a material-recovering-guide plate 15, with the edges of the plates 14,15 on one side making ingress into the magnetic fluid 4 to a considerable depth thereof.

The edge of the plate 14 is spaced a distance from the edge of the plate 15 in the trough so as to provide a space or an opening therebetween.

Running through an upper portion of the trough 3 is a conveyor 10 having comb-shaped flights 9 thereon, with the flights 9 being immersed in the magnetic fluid 4, but in a manner that when the conveyor 10 travels, the tips of the flights 9 will move in contacting relation to the guide plates 14,15.

Materials 6 to be separated which consist of a mixture of non-magnetic materials having varying densities are supplied from a conveyor 17 in the preceding step onto the material-supply guide plate 14, and then forced into the magnetic fluid 4 by means of comb-shaped flights 9 on the conveyor 10, whereby materials 6' having a low density and floating therein may be separated from the materials 6" having a high density and sinking through the fluid 4. The aforesaid separation is carried out mostly in the portions confined between each two of the flights 9, while part of the aforesaid separation is carried out in lower portions of the flights 9.

Materials 6' which have floated are raked by means of the flights 9 on the conveyor 10 from the magnetic fluid 4 onto the material-recovering guide plate 15, then transported therealong and taken from the trough 3 outside to be recovered in a container 11. On the other hand, materials 6" of a high density, which have sunk in the fluid 4, drop off the magnetic fluid 4 from below onto the conveyor 12, then taken from the trough 3 outside to be recovered in a container 13. According to this apparatus, a feeding space of the conveyor 10 may be increased in proportion to the length of the material-separating portion, i.e., the width of the magnetic fluid 4, with an accompanying increase in amount of materials to be processed.

Meanwhile, the flights 9 may be of a flat plate form, but should preferably be of a comb form for the convenience of preventing the magnetic fluid from being raked outside together with the materials 6' to be separated, when the materials 6' are raked or discharged onto the material recovering guide plate 15.

Another embodiment of the invention will be described ith reference to FIG. 5.

Figure 3:
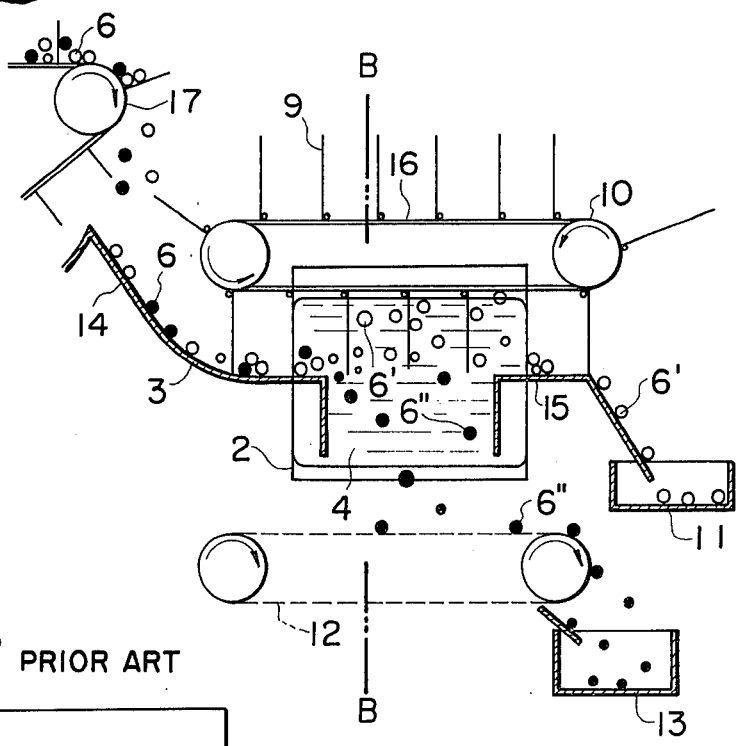
FIG. 3 is a diagrammatic view showing the construction of one embodiment of the invention.
Figure 2:
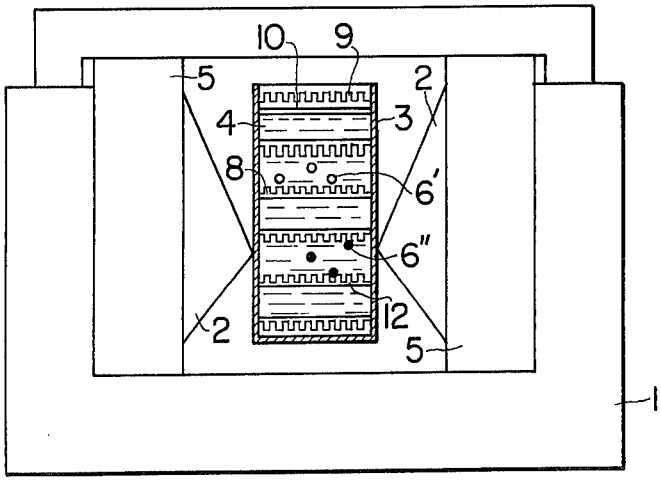
FIG. 2 PRIOR ART
FIG. 2 is a cross-sectional view taken along the line A—A of FIG. 1.
Figure 4:
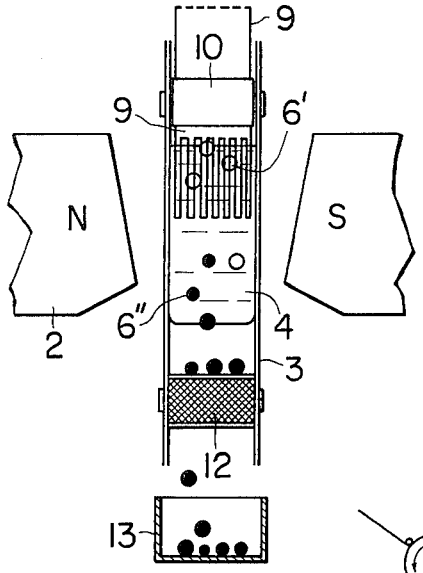
FIG. 4 is a cross-sectional view taken along the line B—B of FIG. 3.
Figure 5:
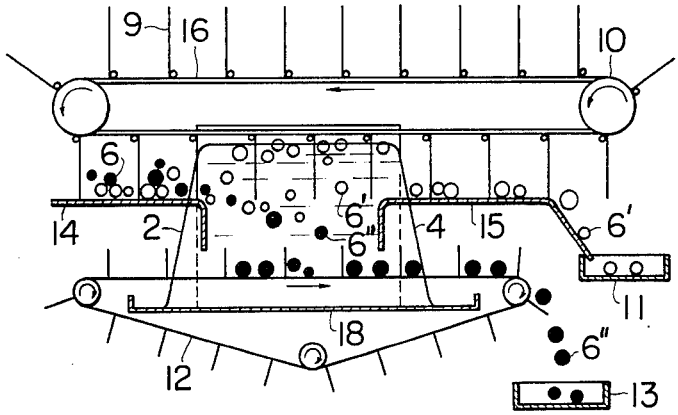
FIG. 5 is a diagrammatic view illustrative of the construction of another embodiment of the invention.

In addition to the apparatus shown in FIGS. 3 and 4, the apparatus of FIG. 5 provides a supporting plate 18 adapted to support a bottom portion of the magnetic fluid 4 within the trough 3, while an upper run of the transferring conveyor 12 runs through the magnetic fluid 4 between the guide plates 14,15 and the supporting plate 18. This arrangement facilitates to hold the magnetic fluid 4 in an air gap defined between pole pieces 2 and allows to enlarge a space, in which materials are to be separated. In addition, a range of the apparent densities of the magnetic fluid 4 may be enlarged.

Still another embodiment of the invention will be described in conjunction with FIG. 6. The apparatus of FIG. 6 adds to those shown in FIGS. 3 and 4 a rotary drum 19 positioned close to an entrance of materials from the material-supply-guide plate 14 into the magnetic fluid 4, within the magnetic fluid 4. The rotary drum 19 serves to receive on its peripheral surface the materials 6 which have dropped off the guide plate 14 into the magnetic fluid 4 and then sunk in the magnetic fluid 4, and serves to feed the materials 6 from its peripheral surface into the magnetic fluid 4 again. This arrangement permits the smooth charging of materials into the magnetic fluid 4. Shown at 20 are resilient members provided in the form of springs for preventing damages of the flights 9 due to materials being jammed thereat.

Figure 6:
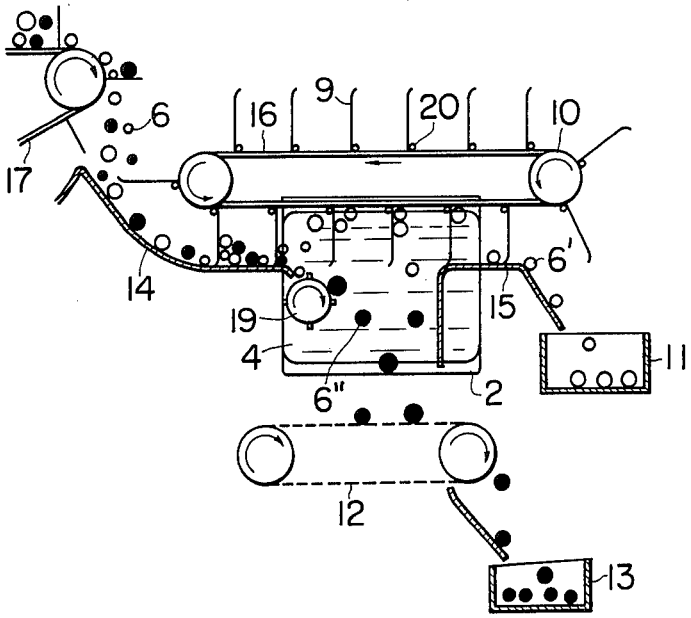
FIG. 6 is a diagrammatic view showing the construction of still another embodiment of the invention.

Like the embodiment shown in FIG. 5, the embodiment of FIG. 6 may be provided with a supporting plate adapted to support a bottom portion of the magnetic fluid, thus achieving the same results as those obtained from the embodiment of FIG. 5.

As is apparent from the foregoing description, the material-separating apparatus according to the present invention may present the following advantages:

(1) The height of a separating portion may be decreased, so that there may be achieved uniform distribution of apparent densities of the magnetic fluid, thereby improving a separating efficiency and accuracy of the apparatus.

(2) A material-separating portion may be provided only by using a small amount of a magnetic fluid.

(3) The dimension of pole pieces may be increased in the transverse direction (in the horizontal direction at a right angle to that of the magnetic field in an air gap), thereby increasing the amount of materials being processed.

(4) The apparatus is simple in construction, improving cost-performance relationship.

What is claimed is:

1. An apparatus for separating substantially non-magnetic materials of different densities, comprising:

means, including a pair of poles pieces laterally spaced from each other on opposite sides of a horizontal conveying path, for generating a magnetic field having a gradient in a vertical direction in an air gap defined between the pair of spaced magnetic pole pieces through which the conveying path extends; generally vertical side walls generally parallel to and on opposite sides of the conveying path; a quantity of magnetic fluid retained completely between both of said side walls, having opposed open entrance and exit end surfaces aligned with the conveying path and an open bottom surface;

a first horizontal guide bottom for supplying the materials to be separated to the magnetic fluid and extending from an end portion outside of one end of said magnetic fluid along said conveying path through the entrance surface of said magnetic fluid to an inside end portion within said magnetic fluid;

a second horizontal guide bottom extending from an inner end portion within said magnetic fluid that is horizontally spaced from and aligned with the first guide bottom inner end, extending along said conveying path through the exit surface of said magnetic fluid to an outside end portion outside of the opposite end of said magnetic fluid, for discharging materials separated by flotation within said magnetic fluid, and having a portion depending from the inner end to adjacent said open bottom surface;

means for supplying a mixture of substantially non-magnetic material of different densities onto the outside end portion of said first horizontal guide bottom;

an endless conveyor means located completely above said magnetic fluid having an endless array of downwardly opening comb-like flights extending into said magnetic fluid and running horizontally along the conveying path through an upper part of said magnetic fluid between said side walls, above said guide bottoms, and through said entrance and exit surfaces of said magnetic fluid;

said conveying means raking material supplied onto the outside end of said first horizontal guide bottom along said first horizontal guide bottom through said entrance surface and into said magnetic fluid to the spacing between said inner end portions of said first and second horizontal guide bottoms, conveying the ones of said materials that are floating within the spacing between said inner end portions across the spacing between said inner end portions onto said inside end portion of said second horizontal guide bottom;

said conveyor means further raking the floating ones of said materials along said second guide bottom through said exit surface and out of said magnetic fluid to a recovery station; and separate means for recovering the others of said materials after they have sunk downwardly in said magnetic fluid through said open bottom surface from the spacing between said inner end portions and downwardly below the endless path of said flights, said separate means being located entirely beneath said magnetic fluid.

2. The apparatus as described in claim 1, further including additional conveying means comprising a conveying drum rotatable about a horizontal axis perpendicular to the conveying path, said drum being immediately below the inner end of said first horizontal guide bottom for moving the sinking ones of said materials downwardly and inwardly with respect to the magnetic fluid.

3. The apparatus as described in claim 1, wherein said conveying means includes an endless belt and means resiliently connecting each of said flights to said endless belt so as to normally extend perpendicular to said endless belt while permitting pivoting of each of said flights away from such vertical position against the bias to prevent jamming of said conveyor means by material being in a position wedged between the inside end of said second horizontal guide bottom and a perpendicularly oriented flight.

* * * * *